US007389757B2

(12) United States Patent
Itoafa et al.

(10) Patent No.: US 7,389,757 B2
(45) Date of Patent: Jun. 24, 2008

(54) FORCE-TRANSMITTING ARRANGEMENT FOR A VALVE TRAIN OF AN INTERNAL-COMBUSTION ENGINE

(75) Inventors: Calin Petru Itoafa, Höchstadt (DE); Friedrich Hieronymus, Willmersbach (DE)

(73) Assignee: Schaeffler KG, Herzogenaurach (DE)

( * ) Notice: Subject to any disclaimer, the term of this patent is extended or adjusted under 35 U.S.C. 154(b) by 166 days.

(21) Appl. No.: 11/298,733

(22) Filed: Dec. 9, 2005

(65) Prior Publication Data

US 2006/0137640 A1 Jun. 29, 2006

Related U.S. Application Data

(60) Provisional application No. 60/640,074, filed on Dec. 29, 2004.

(51) Int. Cl.
*F01L 1/14* (2006.01)

(52) U.S. Cl. ..... 123/90.48; 123/90.59; 123/90.61; 123/90.16

(58) Field of Classification Search ..... 123/90.48, 123/90.49, 90.52, 90.53, 90.55, 90.57
See application file for complete search history.

(56) References Cited

U.S. PATENT DOCUMENTS 2,688,319 A 9/1954 Humphreys
4,462,364 A 7/1984 Kodama
6,318,324 B1 * 11/2001 Koeroghlian et al. .... 123/90.55
6,718,923 B2 * 4/2004 Barth et al. ..... 123/90.55
6,748,914 B2 * 6/2004 Spath et al. ..... 123/90.53

FOREIGN PATENT DOCUMENTS

DE 197 54 016 6/1999

* cited by examiner

*Primary Examiner*—Zelalem Eshete
(74) *Attorney, Agent, or Firm*—Volpe and Koenig, P.C.

(57) ABSTRACT

A force-transmitting arrangement (4) for a valve train (1) of an internal-combustion engine (2) with hydraulic valve play compensation device (6) with a hollow cylindrical compensation piston (15) is provided. The compensation piston (15) borders, on one end, a working space (32) of the valve play compensation device (6) and, on the other end, a hydraulic medium reservoir (33), which is used for supplying the working space (32) and which is connected to a hydraulic medium supply (18) of the internal-combustion engine (2). A run-off safety device (22, 22*a*, 22*b*) at least partially prevents a hydraulic medium flow from the hydraulic medium reservoir (33) in the direction of the hydraulic medium supply (18). The hydraulic medium reservoir (33) includes an inner storage space (17) enclosed by the compensation piston (15) and at least one outer storage space (31) located outside the compensation piston (15), wherein the run-off safety device (22, 22*a*, 22*b*) extends between the hydraulic medium supply (18) and hydraulic medium reservoir (33) into a supply bore (35) arranged in the force-transmitting arrangement (4).

6 Claims, 3 Drawing Sheets

FORCE-TRANSMITTING ARRANGEMENT FOR A VALVE TRAIN OF AN INTERNAL-COMBUSTION ENGINE

FIELD OF THE INVENTION

The invention relates to a force-transmitting arrangement for a valve train of an internal-combustion engine with a hydraulic valve play compensation device with a hollow cylindrical compensation piston. This limits, on one end, a working space of the valve play compensation device and, on the other end, a hydraulic medium reservoir, which is used for feeding the working space and which is connected to a hydraulic medium supply of the internal-combustion engine. Here, a run-off safety device at least partially prevents hydraulic medium from flowing out of the hydraulic medium reservoir in the direction of the hydraulic medium supply.

BACKGROUND

Such force-transmitting arrangements are known to someone skilled in the art of valve controllers with hydraulic valve play compensation and are embodied according to the architecture of the internal-combustion engine. Thus, for the so-called "Overhead Camshaft" valve train construction also known as "OHC" with a camshaft arranged in the cylinder head, for the most part bucket tappets, rocker arms or finger levers, and also stationary pivot bearings for pivot levers are used, each with hydraulic valve play compensation.

In addition, such force-transmitting arrangements also find multipurpose use in the so-called "Overhead Valve" valve train arrangement also known in short as "OHV" predominantly for large-volume internal-combustion engines embodied as V engines. In the OHV arrangement, the valve train is characterized by a camshaft, which is supported in the engine block of the internal-combustion engine in the vicinity of the crankshaft and whose cam lobes are picked up by tappets as force-transmitting arrangements, which can move in the longitudinal direction and which are usually equipped with hydraulic valve play compensation, and are transformed into a stroke movement of each tappet which contacts the cam. The stroke movement of the tappet is typically transmitted to one or more gas-exchange valves allocated to the tappet via a tappet push rod, which activates a rocker arm supported in the cylinder head of the internal-combustion engine.

The known advantages of a hydraulic and thus automatic valve play compensation device includes, in particular, the elimination of the valve play adjustment at the initial assembly and service of the internal-combustion engine, its quiet running, and favorable exhaust-gas emission behavior. However, these advantages can be realized completely only under the assumption that the hydraulic valve play compensation device is functional or ready to function in all operating states, including standstill and starting of the internal-combustion engine. The essential basis for this obviously consists in a suitable supply of hydraulic medium to the valve play compensation device. For this purpose, the hydraulic medium is fed during the operation of the internal-combustion engine by a hydraulic-medium pump via supply lines to a compensation piston of the valve play compensation device, wherein the compensation piston borders a hydraulic pad used for transferring movement or force in a working space. The working space has a variable volume, because the compensation piston is always striving to adjust the height of the hydraulic pad enclosed by the working space, so that mechanical play in the valve train is eliminated during the stroke-free base circle phase of the cam. The compensation piston is typically formed with a hollow cylindrical shape and encloses a hydraulic medium reservoir, which supplies the working space with hydraulic medium by means of a non-return valve during valve play compensation movements, i.e., for an expanding working space. Here, it has proved to be useful that the volume of the hydraulic medium reservoir equals a multiple of the volume of the working space, in order to reliably exclude undesired suctioning of air or gas bubbles into the working space under all operating conditions of the internal-combustion engine.

A starting process of a cold internal-combustion engine represents an especially critical operating state in this condition, wherein the engine typically was turned off with one or more open gas-exchange valves, so that the compensation pistons of the associated valve play compensation devices have descended partially or completely due to extensive displacement of hydraulic medium from the working space due to the force effect of the gas-exchange valve spring and after a period of temporary standstill phase of the internal-combustion engine. In addition, during the starting process the hydraulic medium pump does not deliver any or a sufficient hydraulic medium volume flow to the compensation piston. In this respect, it is essentially the only task of the hydraulic medium reservoir to completely cover the considerable need for hydraulic medium of the working space during its expansion from the descended position of the compensation piston in its working position. An insufficiently large or an insufficiently filled hydraulic medium reservoir would inevitably lead to suctioning of air or gas bubbles into the working space. The consequences of a working space containing air or gas bubbles are known to someone skilled in the art and are perceived audibly and disruptively as so-called valve tapping primarily due to high contact speeds of the gas-exchange valve during its closing process.

The requirement for a sufficiently large hydraulic medium reservoir is increasingly in conflict with the goal of further reducing the installation space and/or the mass of the force-transmitting arrangement or for expanding the functionality of the force-transmitting arrangement for an unchanged installation space. The latter case includes, in particular, variable force-transmitting arrangements, which are formed as switchable cam followers and can transfer the strokes of various cams selectively to the gas-exchange valve according to the switching state of their coupling means and/or can completely cancel out the stroke of a cam. Thus, it is typical, for example, in switchable tappet push rod valve trains with an OHV arrangement to nest cam follower parts, which can move longitudinally relative to each other and which can be coupled to each other, so that the outer and attachment geometry of the cam follower can remain essentially unchanged. However, this usually requires a reduction in installation space of the hydraulic valve play compensation device and consequently a volume reduction of the hydraulic medium reservoir enclosed by the compensation piston with the previously mentioned risk and consequences of a lack of hydraulic medium supply to the working space.

This problem is often intensified in that the force transmitting arrangement and with it the compensation piston together with the hydraulic medium reservoir are installed in the internal-combustion engine at an angle to the force of gravity. This can lead to a significant loss of hydraulic medium from the hydraulic medium reservoir, which also endangers successful refilling of the working space, because the hydraulic medium can return via supply openings from the hydraulic medium reservoir into the hydraulic medium supply.

In the state of the art, there are already approaches to solving this intensification of the problem mentioned above. For example, in U.S. Pat. No. 2,688,319, in U.S. Pat. No. 4,462,364, and also in DE 197 54 016 A1, limiting means are proposed, which are supposed to prevent draining of the hydraulic medium reservoir. However, these limiting means are all arranged in the immediate area of the compensation piston and consequently can guarantee at most a filling level corresponding to the hydraulic medium reservoir enclosed directly by the compensation piston. Consequently, it can be necessary, especially for switchable cam followers with reduced installation space compensation pistons, to expand the then insufficiently large hydraulic medium reservoir by cavities located outside the compensation piston. In this case, the limiting means of the cited documents are unsuitable, because they cannot prevent return of hydraulic medium located outside of the compensation piston.

SUMMARY

Therefore, the object of the invention is to provide a force-transmitting arrangement of the type noted above, so that the cited disadvantages are solved with simple means. Accordingly, a sufficiently large hydraulic medium reservoir protected against run-off is available to the working space of the valve play compensation device at all times, in order to guarantee, in particular, a starting and warm running phase of the internal-combustion engine that is free from valve tapping.

This object is achieved according to the invention in that the hydraulic medium reservoir includes an inner storage space enclosed by the compensation piston and at least one outer storage space located outside the compensation piston, wherein the run-off safety device extends between the hydraulic medium supply and hydraulic medium reservoir in a supply bore arranged in the force-transmitting arrangement.

This arrangement of the run-off safety device ensures that the hydraulic medium reservoir is sufficiently large, because it still includes one or more outer storage spaces in addition to the hydraulic medium volume enclosed directly by the compensation piston. The hydraulic medium reservoir expanded in this way and protected by the run-off safety device from return of hydraulic medium in the direction of the hydraulic medium supply provides a sufficiently large hydraulic medium volume to the working space, especially for a completely descended compensation piston, for air or gas bubble free expansion of the working space for return of the compensation piston to its valve play free working position.

In another configuration of the invention, the run-off safety device should permit the hydraulic medium flow in the supply direction and block this flow in the opposite direction. This is advantageous when run-off safety device is embodied like a seat valve, in order to be able to completely prevent the return of hydraulic medium from the hydraulic medium reservoir in the direction of the hydraulic medium supply.

For this purpose, the supply bore can have in the supply direction a cross-sectional expansion facing the hydraulic medium reservoir with a shoulder, which is used as a seal seat for a sealing body of the run-off safety device. However, as alternative embodiments, a run-off safety device embodied in the form of a non-return valve or a plate-valve shaped run-off safety devices closing the supply bore are also conceivable and included in the scope of the invention.

The sealing body is especially advantageous if it is formed as a ball. This can belong to a ball non-return valve with a valve spring, which, on one hand, applies pressure on the ball in the direction of the seal seat and, on the other hand, is supported by a valve cap arranged in the cross-sectional expansion. Hereby it is guaranteed that the ball can reliably reach and sufficiently seal the seal seat also against external force effects, such as, for example, friction forces.

In a refinement of the invention, the force-transmitting arrangement is formed as a tappet, which activates a hollow cylindrical tappet push rod. Here, a hollow space of the tappet push rod can be used as an outer storage space of the hydraulic medium reservoir, in that the hollow space of the tappet push rod is in fluid connection with the inner storage space of the compensation piston.

A volume expansion of the hydraulic medium reservoir created in this way is suitable especially for tappets, which are switchable via a locking mechanism. For a locked locking mechanism, a positive connection is created between a first tappet part and a second tappet part that can telescopically move relative to this first part, while for an unlocked locking mechanism, this positive connection is not produced. In this respect, the locking mechanism enables an interruption of movement of the first tappet part relative to the second tappet part, which activates the tappet push rod. For the tappet formed in this way, typically there is only limited installation space available to the compensation piston due to the additional tappet part, so that first the hydraulic medium reservoir expanded by the outer storage space can provide a sufficiently large hydraulic medium volume to the working space.

In another useful improvement of the invention, the supply bore extends into a connecting piece, which is formed between an annular channel and an annular space of the second tappet part.

The invention can be applied advantageously primarily for switchable tappets, which are also arranged in an OHV constructed internal-combustion engine, because the compensation piston must cover a relatively large path between the descended position and its working position for a correspondingly large refilling need of the working space with hydraulic medium due to the considerably and summing chain of component tolerances in the OHV construction. Nevertheless, the invention can be used anywhere a sufficiently large hydraulic medium reservoir protected against run-off is to be provided at any time to the working space of the valve play compensation device. In this respect, the invention is also especially effective when a longitudinal axis of the force-transmitting arrangement supported in the internal-combustion engine is inclined to the direction of the force of gravity. Through this configuration, draining of the hydraulic medium reservoir itself can be reliably prevented at extreme inclinations of the force-transmitting arrangement.

BRIEF DESCRIPTION OF THE DRAWINGS

Additional features of the invention result from the following description and from the drawings, in which an exemplary embodiment of a force-transmitting arrangement according to the invention is shown with reference to a tappet valve train in an OHV arrangement for various embodiments of the run-off safety device. Shown are.

In the figures, the same reference numbers designate the same or functionally equivalent components, as long as no contrary statement are provided.

DETAILED DESCRIPTION OF THE PREFERRED EMBODIMENTS

Figure 1:
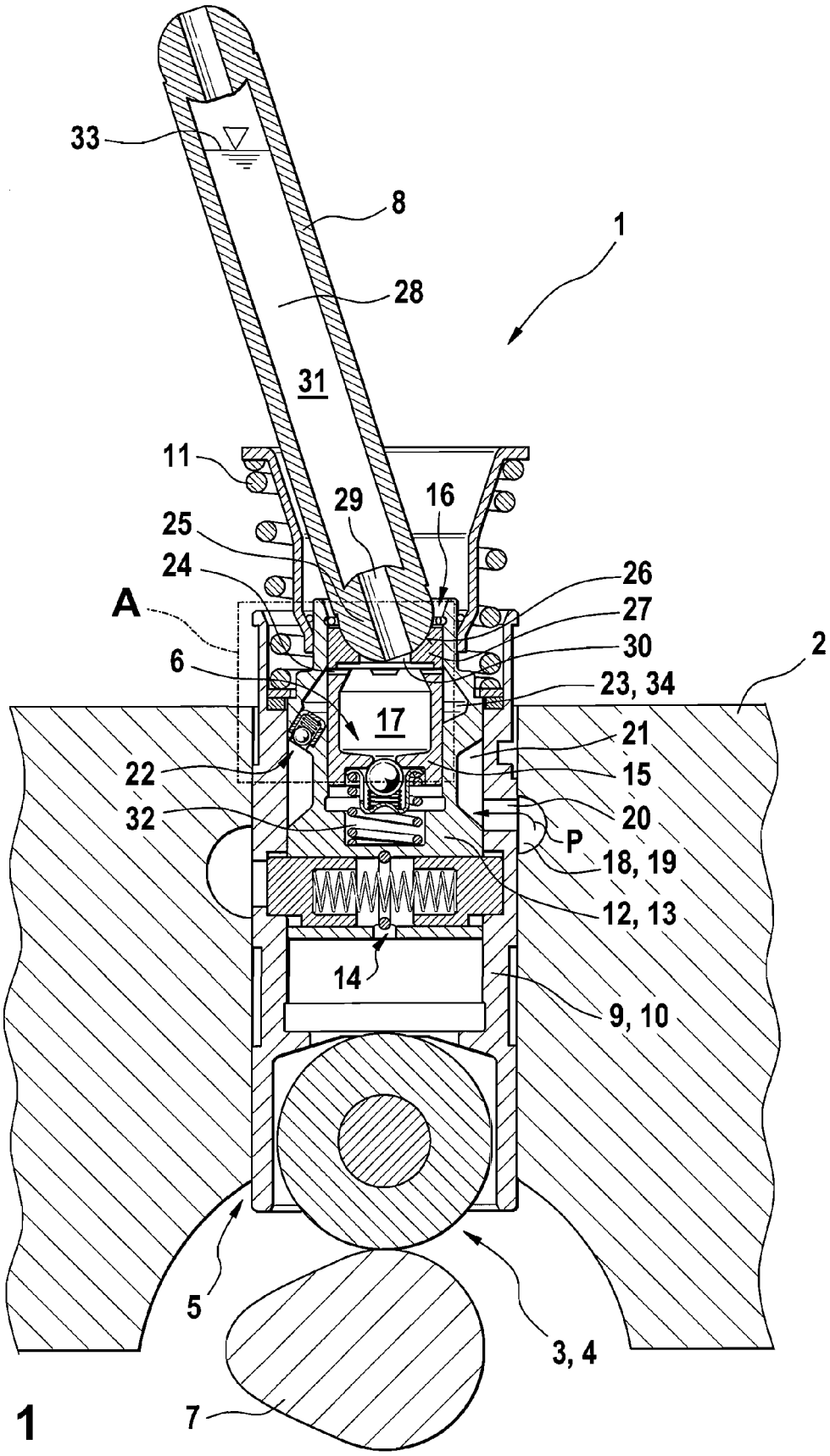
FIG. 1 a longitudinal cross-sectional view of the tappet valve train supported in the internal-combustion engine with a first variant of the run-off safety device in the form of a spring-loaded ball non-return valve, FIG. 2 an enlarged view of the cross-section indicated at A with the ball non-return valve from FIG. 1, FIG. 3 an enlarged view of a valve cap for the ball non-return valve from FIGS. 1 and 2, FIG. 4 an enlarged view of the cross-section indicated at A with a second embodiment of the run-off safety device, and FIG. 5 an enlarged view of the cross-section indicated at A with a third embodiment of the run-off safety device.

FIG. 1 provides a cross-section of a valve train 1 of an internal-combustion engine 2. Shown is a force-transmitting arrangement 4, which is embodied as a tappet 3 and which is supported so that it can move in a longitudinal direction in a hollow cylindrical guide 5 of the internal-combustion engine 2. The tappet 3 is biased by means of a hydraulic valve play compensation device 6 between a cam 7 of the internal-combustion engine 2 and a tappet push rod 8 in the longitudinal or stroke direction, as is known to those skilled in the art. The tappet 3 shown here further offers the ability to stop a gas-exchange valve that is activated by the valve train 1 but is not shown, such that the transfer of the movement of the stroke originating from the cam 7 to the tappet push rod 8 is interrupted by the tappet 3. For this purpose, the tappet 3 has a first tappet part 10, which is provided as an outer part 9 and which can move telescopically against the force of a lost-motion spring 11 relative to a second tappet part 13 formed as an inner part 12. For transferring movement, the outer part 9 is coupled with a positive connection to the inner part 12 in the extended position of the tappet 3 via a locking mechanism 14 according to the illustration. The possibilities that are opened up with the variability of the tappet 3 in terms of fuel consumption and emission behavior of the internal-combustion engine are also known to a person skilled in the art of internal-combustion engines. To form such a switchable tappet 3, however, it should be mentioned that typically only a considerably limited installation space is available for a hollow cylindrical compensation piston 15 of the hydraulic valve play compensation device 6. This is because the compensation piston 15 is now arranged in a hollow cylindrical recess 16 of the inner part 12 guided in the outer part 9, wherein its installation space is reduced by approximately the sum of the thickness of the housing walls of the inner part 12 surrounding the compensation piston 15. In this respect, the hydraulic medium volume directly enclosed by the hollow cylindrical compensation piston 15 and used as an inner storage space 17 has a significantly limited volume relative to non-switchable tappets.

A hydraulic medium supply 18, which provides pressurized hydraulic medium in the supply direction "P" in the form of an oil gallery 19 intersecting with the guide 5 in the operation of the internal-combustion engine 2, is used to supply the hydraulic valve play compensation device 6. The hydraulic medium is led first via an opening 20, which is arranged in the outer part 9 and which is in fluid connection with the oil gallery 19 at least in the shown stroke-free position of the cam 7, into an annular channel 21 running between the inner part 12 and outer part 9. From there, it passes a run-off safety device 22, which borders an annular space 23, and from there the hydraulic medium reaches the inner storage space 17 enclosed by the compensation piston via at least one end recess 24 of the compensation piston 15.

The tappet push rod 8 is supported in an articulated way with a spherical end 25 in a dome-shaped formation 26 of a piston top part 27 supported on the compensation piston 15. A hollow space 28 of the tappet push rod 8 is in fluid connection via an opening 29 in the spherical end 25 and also via an opening 30 in the piston top part 27 with the inner storage space 17 and forms an outer storage space 31. For limiting the hydraulic medium volume flow into the tappet push rod 8, it is also known to use a so-called throttle plate (not shown), which is typically arranged between the compensation piston 15 and the piston top part 27 and which closes the opening 30 in the piston top part 27 essentially to a cross section that throttles the volume flow. Furthermore, the throttle plate can be formed, for example, by suitable recesses, so that a hydraulic medium volume flow is achieved with low throttling from the tappet push rod 8 in the direction of the compensation piston 15.

The function of the run-off safety device 22 is to provide a sufficiently large hydraulic medium reservoir 33 especially during the starting phase of the internal-combustion engine 2 to a working space 32 of the valve play compensation device 6 bordered by the compensation piston 15. This is guaranteed in that the hydraulic medium reservoir 33 is protected from draining in the direction of the oil gallery 19, i.e., from draining into the oil gallery 19 and into the guide 5, during the standstill phase of the internal-combustion engine 2. For this purpose, the run-off safety device 22 is embodied and arranged so that it permits a hydraulic medium flow in the supply direction "P" and blocks flow in the direction opposite the supply direction "P". Therefore, in the embodiment from FIG. 1, the hydraulic medium reservoir 33 includes the inner storage space 17, the outer storage space 31, and also an outer storage space 34 formed by the annular space 23.

Figure 2:
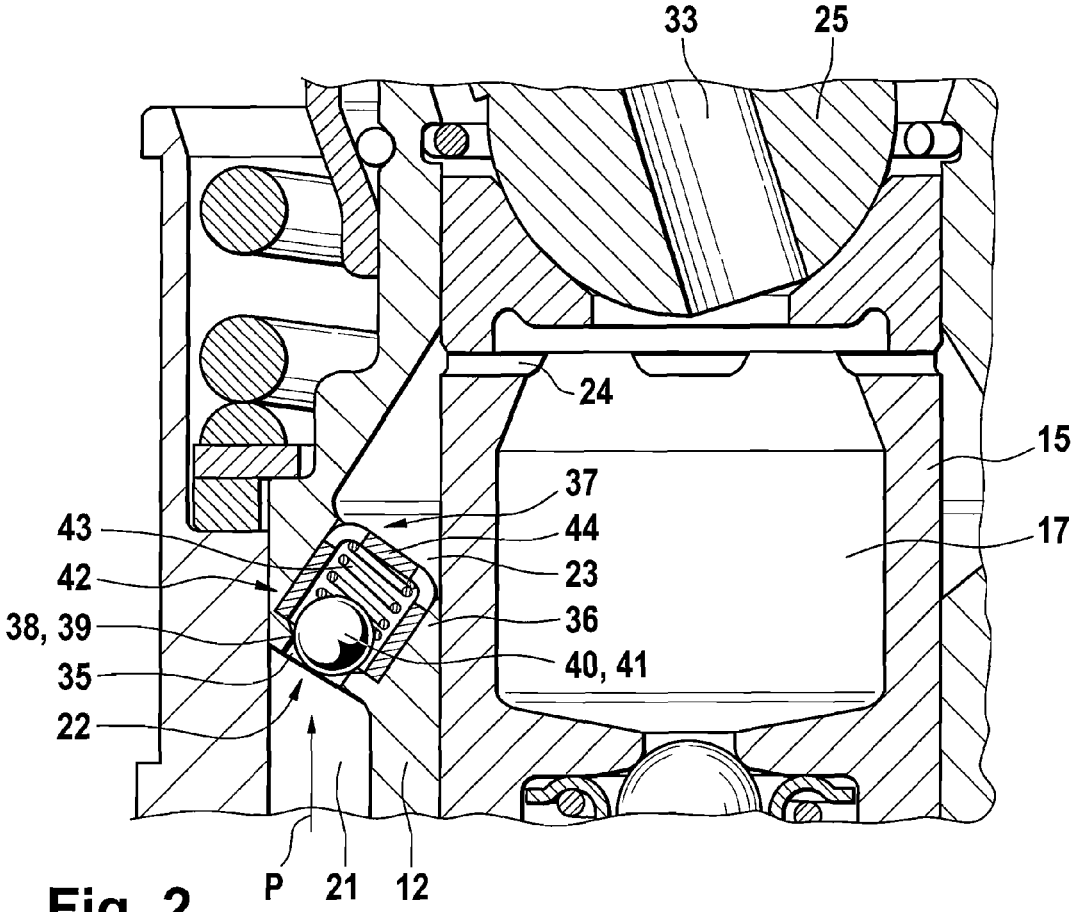

The subsequent Figures present alternative embodiments of the run-off safety device 22 in an enlarged view of the cross-section indicated at A in FIG. 1. The run-off safety device 22 shown in FIG. 2 is identical to that in FIG. 1. The run-off safety device 22 is arranged in a supply opening 35, which extends in a connecting piece 36 formed by the annular channel 21 and the annular space 23 of the inner part 12. In the supply direction "P" the supply bore 35 has a cross-sectional expansion 37 facing the hydraulic medium reservoir 33. Here, a shoulder 38 of the cross-sectional expansion 37 is used as a seal seat 39 for a sealing body 40, which is formed as a ball 41 of a ball non-return valve 42 in this embodiment of the run-off safety device 22. The ball non-return valve 42 includes a valve spring 43, which applies a force on the ball 41 in the direction of the seal seat 39, and also a valve cap 44, which is fixed in the cross-sectional expansion 37 and on which the valve spring 43 is supported.

Figure 3:
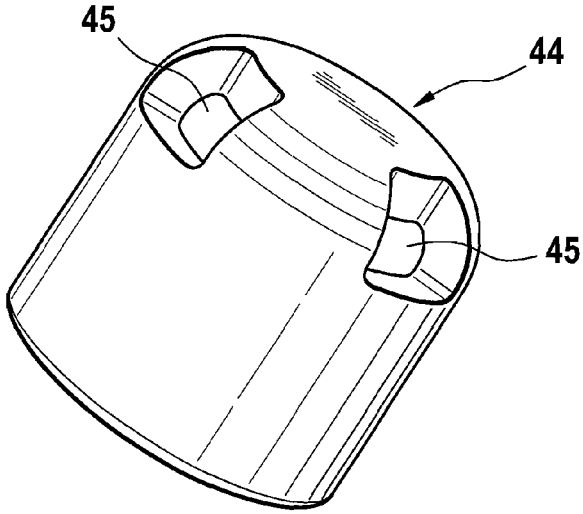

FIG. 3 shows the valve cap 44 in a greatly enlarged perspective view. Openings 45, which permit a flow of pressurized hydraulic medium to the hydraulic medium reservoir 33 for an open run-off safety device 22, i.e., for a ball 41 located at a distance from the seal seat 39, can be clearly recognized. A spring-loaded run-off safety device 22 according to FIG. 2 is suitable especially for force-transmitting arrangements, which are arranged in the internal-combustion engine greatly inclined to the direction of the force of gravity, because here, under some circumstances, just force of gravity component is not sufficient to press the sealing body 40 onto the seal seat 39 to form a seal.

Figure 4:
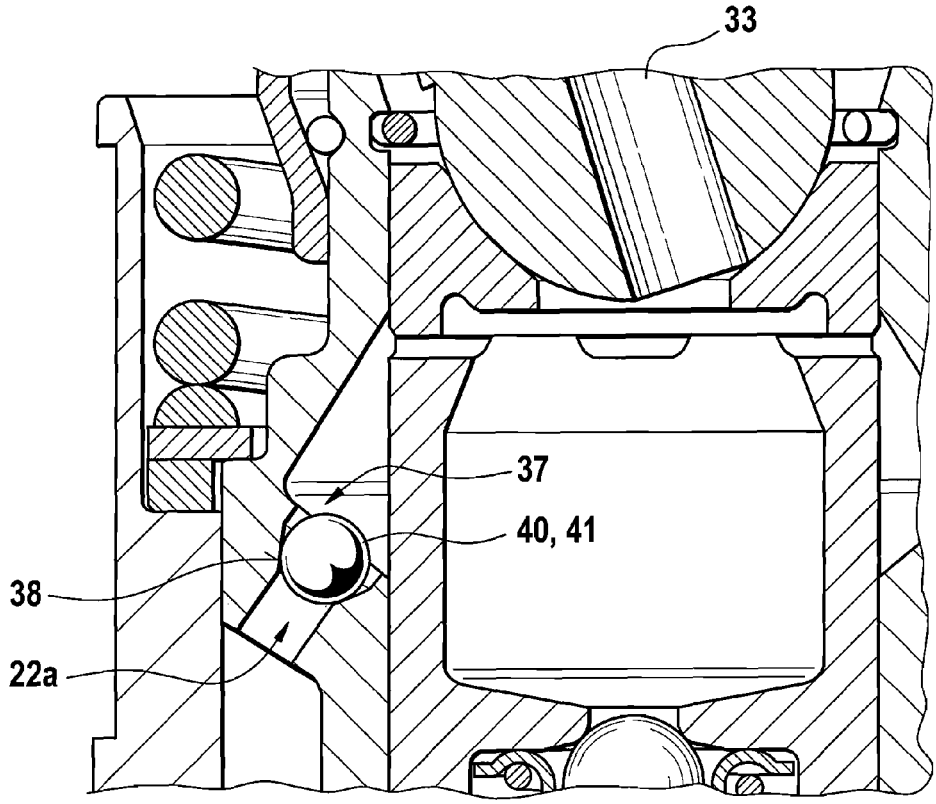

A spring force-free embodiment of a run-off safety device 22*a* is shown in FIG. 4 in the enlarged view of the cut-out A from FIG. 1. The difference with the run-off safety device 22 shown in FIG. 2 is that, for the run-off safety device 22*a*, essentially the sealing body 40 also formed as a ball 41 contacts the shoulder 38 of the cross-sectional expansion 37 to form a seal merely through its force of gravity component and also the weight of the hydraulic medium reservoir 33 loading the sealing body.

Figure 5:
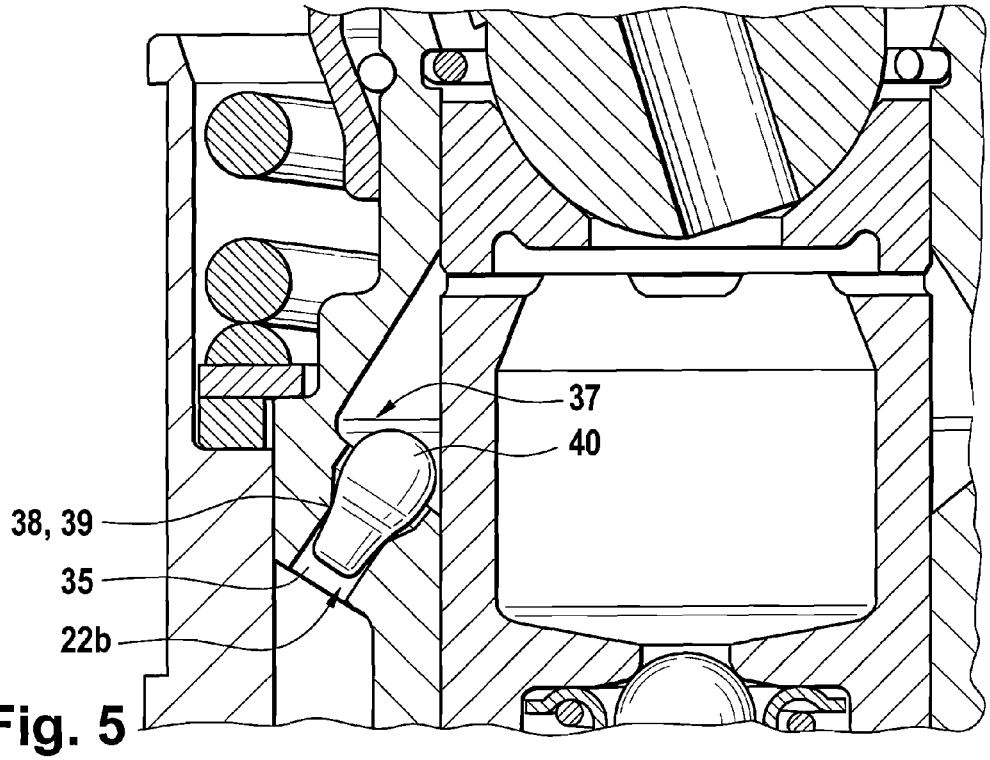

A run-off safety device 22*b* that is an alternative to the embodiment presented in FIG. 4 is shown in FIG. 5. The sealing body 40 has a conical longitudinal cross section extending essentially complementary to the cross-sectional expansion 37. This shape guarantees that the sealing body 40 is guided in the longitudinal direction with play in the supply bore 35 and thus its freedom of motion perpendicular to the supply bore 35 is limited. This shape of the run-off safety device 22*b* thus permits for a minimum number of components a reliable and reproducible sealing of the seal seat 39 formed in turn by the shoulder 38 of the cross-sectional expansion 37 by the sealing body 40, whose stopping point can rock only slightly for an open run-off safety device 22*b*.

Although the present invention was described with reference to preferred embodiments, it is not limited to these embodiments, but instead can also obviously be used in other force-transmitting arrangements for valve trains, such as, for example, cup tappets with hydraulic valve play compensation elements and also hydraulic support and plug-in elements, each with or without variability.

LIST OF REFERENCE NUMBERS AND SYMBOLS

1 Valve train
2 Internal-combustion engine
3 Tappet
4 Force-transmitting arrangement
5 Guide
6 Valve play compensation device
7 Cam
8 Tappet push rod
9 Outer part
10 First tappet part
11 Lost-motion spring
12 Inner part
13 Second tappet part
14 Locking mechanism
15 Compensation piston
16 Recess
17 Inner storage space
18 Hydraulic medium supply
19 Oil gallery
20 Opening
21 Annular channel
22 Run-off safety device
22*a* Run-off safety device
22*b* Run-off safety device
23 Annular space
24 Recess
25 Spherical end
26 Formation
27 Piston top part
28 Hollow space
29 Opening
30 Opening
31 Outer storage space
32 Working space
33 Hydraulic medium reservoir
34 Outer storage space
35 Supply opening
36 Connecting piece
37 Cross-sectional expansion
38 Shoulder
39 Seal seat
40 Sealing body
41 Ball
42 Ball non-return valve
43 Valve spring
44 Valve cap
45 Opening
P Supply direction The inventioned claimed is:

1. Force-transmitting arrangement for a valve train of an internal-combustion engine comprising a hydraulic valve play compensation device with a hollow cylindrical compensation piston, which borders, on one end, a working space of the valve play compensation device and borders, on an other end, a hydraulic medium reservoir, which is used for supplying the working space and which is connected to a hydraulic medium supply of the internal-combustion engine, wherein a run-off safety device at least partially prevents a hydraulic medium flow from the hydraulic medium reservoir in a direction of the hydraulic medium supply, the hydraulic medium reservoir includes an inner storage space enclosed by the compensation piston and at least one outer storage space located outside of the compensation piston, wherein the run-off safety device extends between the hydraulic medium supply and hydraulic medium reservoir in a supply opening arranged in the force-transmitting arrangement, wherein the supply opening has in the supply direction a cross-sectional expansion facing the hydraulic medium reservoir with a shoulder, which is used as a seal seat for a sealing body of the run-off safety device.

2. Force-transmitting arrangement according to claim 1, wherein the sealing body is formed as a ball.

3. Force-transmitting arrangement according to claim 2, wherein the ball is a part of a ball non-return valve with a valve spring, which, on one hand, applies a force on the ball in a direction of the seal seat and, on the other hand, is supported by a valve cap arranged in the cross-sectional expansion.

4. Force-transmitting arrangement for a valve train of an internal-combustion engine comprising a hydraulic valve play compensation device with a hollow cylindrical compensation piston, which borders, on one end, a working space of the valve play compensation device and borders, on an other end, a hydraulic medium reservoir, which is used for supplying the working space and which is connected to a hydraulic medium supply of the internal-combustion engine, wherein a run-off safety device at least partially prevents a hydraulic medium flow from the hydraulic medium reservoir in a direction of the hydraulic medium supply, the hydraulic medium reservoir includes an inner storage space enclosed by the compensation piston and at least one outer storage space located outside of the compensation piston, wherein the run-off safety device extends between the hydraulic medium supply and hydraulic medium reservoir in a supply opening arranged in the force-transmitting arrangement, the run-off safety device permits hydraulic medium flow in a supply direction and blocks the flow in a direction opposite the supply direction, the run-off safety device is formed as a seat valve, the force-transmitting arrangement comprises a tappet for actuating a hollow cylindrical tappet push rod, and at least one outer storage space is formed by a hollow space of the tappet push rod.

5. Force-transmitting arrangement according to claim 4, wherein the tappet is switchable via a locking mechanism, which permits an at least partial disruption in a transfer of movement from a first tappet part to a second tappet part, which can telescope relative to the first tappet part and which activates the tappet push rod.

6. Force-transmitting arrangement for a valve train of an internal-combustion engine comprising a hydraulic valve play compensation device with a hollow cylindrical compensation piston, which borders, on one end, a working space of the valve play compensation device and borders, on an other end, a hydraulic medium reservoir, which is used for supplying the working space and which is connected to a hydraulic medium supply of the internal-combustion engine, wherein a run-off safety device at least partially prevents a hydraulic medium flow from the hydraulic medium reservoir in a direction of the hydraulic medium supply, the hydraulic medium reservoir includes an inner storage space enclosed by the compensation piston and at least one outer storage space located outside of the compensation piston, wherein the run-off safety device extends between the hydraulic medium supply and hydraulic medium reservoir in a supply opening arranged in the force-transmitting arrangement, the run-off safety device permits hydraulic medium flow in a supply direction and blocks the flow in a direction opposite the supply direction, the run-off safety device is formed as a seat valve, the force-transmitting arrangement comprises a tappet for actuating a hollow cylindrical tappet push rod, the at least one outer storage space comprises a hollow space of the tappet push rod, the tappet is switchable via a locking mechanism, which permits an at least partial disruption in a transfer of movement from a first tappet part to a second tappet part, which can telescope relative to the first tappet part and which activates the tappet push rod, and the supply opening extends into a connecting piece, which is located between an annular channel and an annular space of the second tappet part.

* * * * *